US009676583B2

(12) United States Patent
Kosaka

(10) Patent No.: US 9,676,583 B2
(45) Date of Patent: Jun. 13, 2017

(54) SHEET CONVEYING DEVICE

(71) Applicant: BROTHER KOGYO KABUSHIKI KAISHA, Nagoya-shi, Aichi-ken (JP)

(72) Inventor: Raizo Kosaka, Konan (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/974,068

(22) Filed: Dec. 18, 2015

(65) Prior Publication Data

US 2016/0185550 A1 Jun. 30, 2016

(30) Foreign Application Priority Data

Dec. 24, 2014 (JP) ..... 2014-260507

(51) Int. Cl.
*B65H 31/00* (2006.01)
*B65H 29/70* (2006.01)
(Continued)

(52) U.S. Cl.
CPC ..... *B65H 29/70* (2013.01); *B65H 29/125* (2013.01); *B65H 29/14* (2013.01); *B65H 29/52* (2013.01);
(Continued)

(58) Field of Classification Search
CPC ..... B65H 29/125; B65H 29/14; B65H 29/20; B65H 29/22; B65H 29/52; B65H 29/70; B65H 5/062; B65H 5/068; B65H 5/38; B65H 2301/5121; B65H 2301/51214; B65H 2301/5122; B65H 2402/30; B65H 2402/35; B65H 2402/52; B65H 2402/521; B65H 2402/522; B65H 2402/5221;
(Continued)

(56) References Cited

U.S. PATENT DOCUMENTS 8,210,517 B2 7/2012 Osakabe et al.
8,991,817 B1 * 3/2015 Terao ..... B65H 29/70 271/188
(Continued)

FOREIGN PATENT DOCUMENTS

JP 5-338895 A 12/1993
JP 2006-335490 A 12/2006
JP 2010-47395 A 3/2010

*Primary Examiner* — Prasad Gokhale
(74) *Attorney, Agent, or Firm* — Merchant & Gould P.C.

(57) ABSTRACT

A sheet conveying device includes a casing, first discharge rollers arranged in an axial direction, a roller shaft supporting the first discharge rollers and configured to rotate together with the first discharge rollers, second discharge rollers provided in correspondence with the first discharge rollers, a bearing member attached to the casing such that the bearing member is entirely located between adjacent two of the first discharge rollers, the bearing member supporting roller shaft. The bearing member includes a downstream guide located downstream of the roller shaft in a conveying direction in which the sheet is conveyed. The downstream guide of the bearing member protrudes toward the plurality of second discharge rollers beyond a tangential line at a contact point between one of the first discharge rollers and a corresponding one of the second discharge rollers, when viewed in the axial direction.

11 Claims, 5 Drawing Sheets

(51) Int. Cl.
*B65H 29/12* (2006.01)
*B65H 29/52* (2006.01)
*B65H 29/14* (2006.01)

(52) U.S. Cl.
CPC ..... *B65H 2301/4212* (2013.01); *B65H 2301/51214* (2013.01); *B65H 2402/52* (2013.01); *B65H 2402/64* (2013.01); *B65H 2404/51* (2013.01); *B65H 2404/61* (2013.01); *B65H 2801/06* (2013.01)

(58) Field of Classification Search
CPC ..... B65H 2402/64; B65H 2404/14; B65H 2404/143; B65H 2404/17; B65H 2404/50; B65H 2404/51; B65H 2404/511; B65H 2404/512; B65H 2404/60; B65H 2404/61
See application file for complete search history.

(56) References Cited

U.S. PATENT DOCUMENTS

2007/0000966 A1 1/2007 Tsusaka et al.
2009/0295061 A1* 12/2009 Honda ..... B41J 13/0036 271/3.14
2011/0222944 A1* 9/2011 Tanaka ..... B65H 5/062 399/407
2012/0119431 A1* 5/2012 Kobayashi ..... B65H 3/44 271/3.19
2015/0091235 A1* 4/2015 Noso ..... G03G 15/6573 271/3.2

* cited by examiner

SHEET CONVEYING DEVICE

CROSS-REFERENCE TO RELATED APPLICATION

This application claims priority from Japanese Patent Application No. 2014-260507 filed on Dec. 24, 2014, the content of which is incorporated herein by reference in its entirety.

FIELD OF DISCLOSURE

The disclosure relates to a sheet conveying device configured to convey a sheet by holding the sheet between a pair of discharge rollers.

BACKGROUND

A known sheet conveying device includes two discharge rollers spaced apart from each other in an axial direction. The known sheet conveying device is configured to discharge a sheet by curving the sheet in a width direction of the sheet between the discharge rollers. For example, the known sheet conveying device includes a plurality of ribs, which are disposed upstream of the discharge rollers in a sheet conveying direction perpendicular to the axial direction, arranged in a space corresponding to between the discharge rollers, and configured to contact a sheet such that the sheet is curved or flexed at positions in a width direction thereof. Thus, the sheet is curved before it is discharged. When the sheet is discharged, a leading end of the sheet is prevented from hanging down from between the discharge rollers and pushing another sheet, which has been already discharged.

SUMMARY

However, in the above-described technique, when a roller shaft supporting the discharge rollers is flexed, positions of the discharge rollers relative to the ribs may be changed. Accordingly, the positional relationship between a sheet curved by the ribs and the discharge rollers may change.

One or more aspects of the disclosure are to provide a sheet conveying device in which a positional relationship between a sheet and discharge rollers may be maintained.

According to an aspect of the disclosure, a sheet conveying device includes a casing, a plurality of first discharge rollers arranged in an axial direction, the plurality of first discharge rollers including two first discharge rollers adjacent to each other, a roller shaft supporting the plurality of first discharge rollers and configured to rotate together with the plurality of first discharge rollers, a plurality of second discharge rollers provided in correspondence with the plurality of first discharge rollers, the plurality of second discharge rollers including two second discharge rollers adjacent to each other and corresponding to the two first discharge rollers, each of the plurality of first discharge rollers and a corresponding one of the plurality of second discharge rollers being configured to hold and convey a sheet therebetween, and a bearing member attached to the casing such that the bearing member is entirely located between the two first discharge rollers, the bearing member supporting the roller shaft. The bearing member includes a downstream guide located downstream of the roller shaft in a conveying direction in which the sheet is conveyed. The downstream guide of the bearing member protrudes toward the plurality of second discharge rollers beyond a tangential line at a contact point between one of the plurality of first discharge rollers and a corresponding one of the plurality of second discharge rollers, when viewed in the axial direction.

According to the sheet conveying device structured above, a sheet may be curved or flexed in a width direction by the bearing member located between the two first discharge rollers. Thus, the positional relationship between a sheet the first discharge rollers, and respective second discharge rollers may be maintained.

DETAILED DESCRIPTION

An illustrative embodiment of the disclosure will be described in detail with reference to the accompanying drawings. In the following description, a general structure of a laser printer 1 including a sheet conveying device, e.g., a discharge unit 9, will be described first, and then features of the disclosure will be described.

Figure 1:
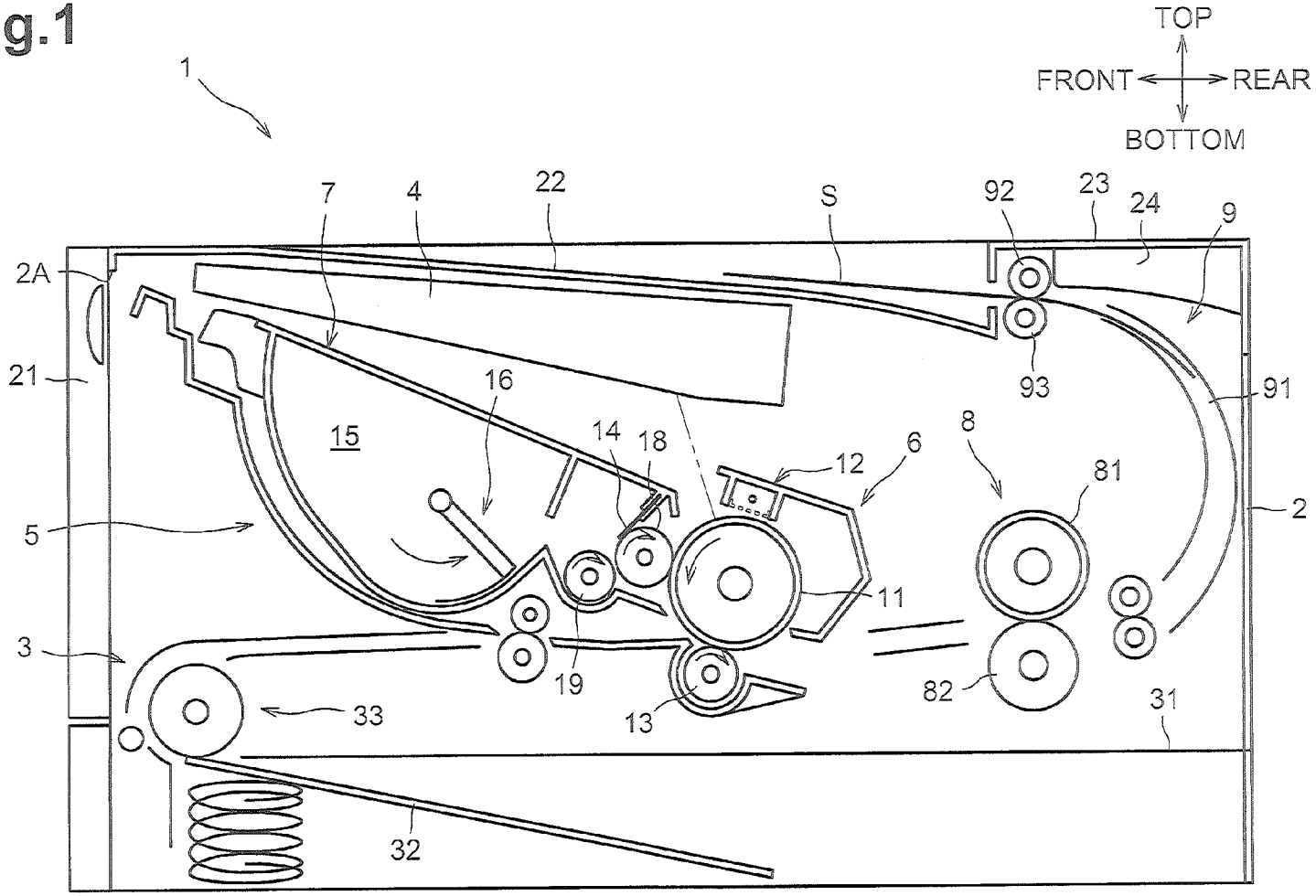
FIG. 1 is a schematic diagram of a laser printer including a discharge unit in an illustrative embodiment according to one or more aspects of the disclosure.

Hereinafter, description will be made with reference to directions that are defined in conjunction with an orientation in which a user uses the laser printer 1. In other words, left and right sides in FIG. 1 are defined as front and rear sides of the laser printer 1, respectively. Front and back sides of the sheet of FIG. 1 are defined as right and left sides of the laser printer 1, respectively. Upper and lower sides in FIG. 1 are defined as top/upper and bottom/lower sides of the laser printer 1, respectively.

As depicted in FIG. 1, the laser printer 1 mainly includes a casing 2, a sheet supply unit 3 configured to supply a recording medium, e.g., a sheet S, an exposure device 4, a process cartridge 5 configured to transfer a toner image on the sheet S, a fixing device 8 configured to thermally fix the toner image on the sheet S, and a discharge unit 9.

The casing 2 includes a front cover 21 configured to cover a front portion of the casing 2. The front cover 21 is configured to pivot to open or close an opening 2A formed on a front side of the casing 2. The casing 2 includes a cover, e.g., a top cover 23, configured to cover an upper side of the casing 2.

The sheet supply unit 3 is disposed in a lower portion of the casing 2. The sheet supply unit 3 mainly includes a sheet supply tray 31, a sheet lift plate 32, and a sheet supply mechanism 33. One or more sheets S accommodated in the sheet supply tray 31 are raised by the sheet lift plate 32 and supplied by the sheet supply mechanism 33 toward the process cartridge 5 (e.g., between a photosensitive drum 11 and a transfer roller 13).

The exposure device 4 is disposed in an upper portion of the casing 2. The exposure device 4 includes a laser light emitting portion, a polygon mirror, a lens, and a reflecting mirror, which are not depicted in the drawings. In the exposure device 4, laser light (see the dash-dot line in FIG.

1) emitted from the laser light emitting portion based on image data scans at high speed across the surface of the photosensitive drum 11, to expose the surface of the photosensitive drum 11 to light.

The process cartridge 5 is configured to be removably attached to the casing 2 through the opening 2A, which is open when the front cover 21 pivots to the front. The process cartridge 5 is located below the exposure device 4 when the process cartridge 5 is mounted on the casing 2. The process cartridge 5 includes a drum cartridge 6 and a developing cartridge 7.

The drum cartridge 6 mainly includes the photosensitive drum 11, a charger 12, and a transfer roller 13.

The developing cartridge 7 is configured to be removably attached to the drum cartridge 6. The developing cartridge 7 attached to the drum cartridge 6, e.g., the process cartridge 5, is configured to be removably attached to casing 2. The developing cartridge 7 mainly includes a developing roller 18, a supply roller 19, a layer-thickness regulating blade 14, a toner chamber 15 configured to store toner therein, and an agitator 16.

In the process cartridge 5, the surface of the photosensitive drum 11 is uniformly charged by the charger 12. Thereafter, laser light from the exposure device 4 scans at high speed across the surface of the photosensitive drum 11, to expose the surface of the photosensitive drum 11 to light. An electrostatic latent image based on image data is formed on the photosensitive drum 11. Toner in the toner chamber 15 is supplied to the supply roller 19 while being agitated by the agitator 16. Then, the toner is supplied from the supply roller 19 to the developing roller 18. Thereafter, the toner enters between the developing roller 18 and the layer-thickness regulating blade 14 in response to the rotation of the developing roller 18, and is carried on the developing roller 18 as a thin layer having a uniform thickness.

The toner carried on the developing roller 18 is supplied from the developing roller 18 to the electrostatic latent image formed on the photosensitive drum 11. Thus, the electrostatic latent image is made visible and a toner image is formed on the photosensitive drum 11. Thereafter, the toner image on the photosensitive drum 11 is transferred onto a sheet S as the sheet S is conveyed between the photosensitive drum 11 and the transfer roller 13.

The fixing device 8 is disposed behind the process cartridge 5. The fixing device 8 mainly includes a heat roller 81 and a pressure roller 82 pressed against the heat roller 81. In the fixing device 8, the toner image transferred onto the sheet S is thermally fixed on the sheet S while the sheet S passes between the heat roller 81 and the pressure roller 82. The sheet S having the toner image thermally fixed thereon is discharged by the discharge unit 9 onto a discharge tray 22 formed on the top cover 23.

Next, a structure of the discharge unit 9 will be described in detail. The discharge unit 9 mainly includes a discharge path 91, first discharge rollers 92 (only one roller 92 depicted in FIG. 1) disposed at an exit of the discharge path 91, and second discharge rollers 93 (only one roller 93 depicted in FIG. 1) configured to convey a sheet S frontward while holding the sheet S with the corresponding first discharge rollers 92.

The discharge path 91 is a path through which a sheet S is conveyed. The discharge path 91 is disposed in a rear portion of the casing 2. The discharge path 91 extends upward from a position behind the fixing device 8 and then frontward while curving. The top cover 23 covers the discharge path 91 from above. Guide ribs 24 (only one rib 24 depicted in FIG. 1) configured to guide a sheet S are disposed at the discharge path 91.

Figure 4:
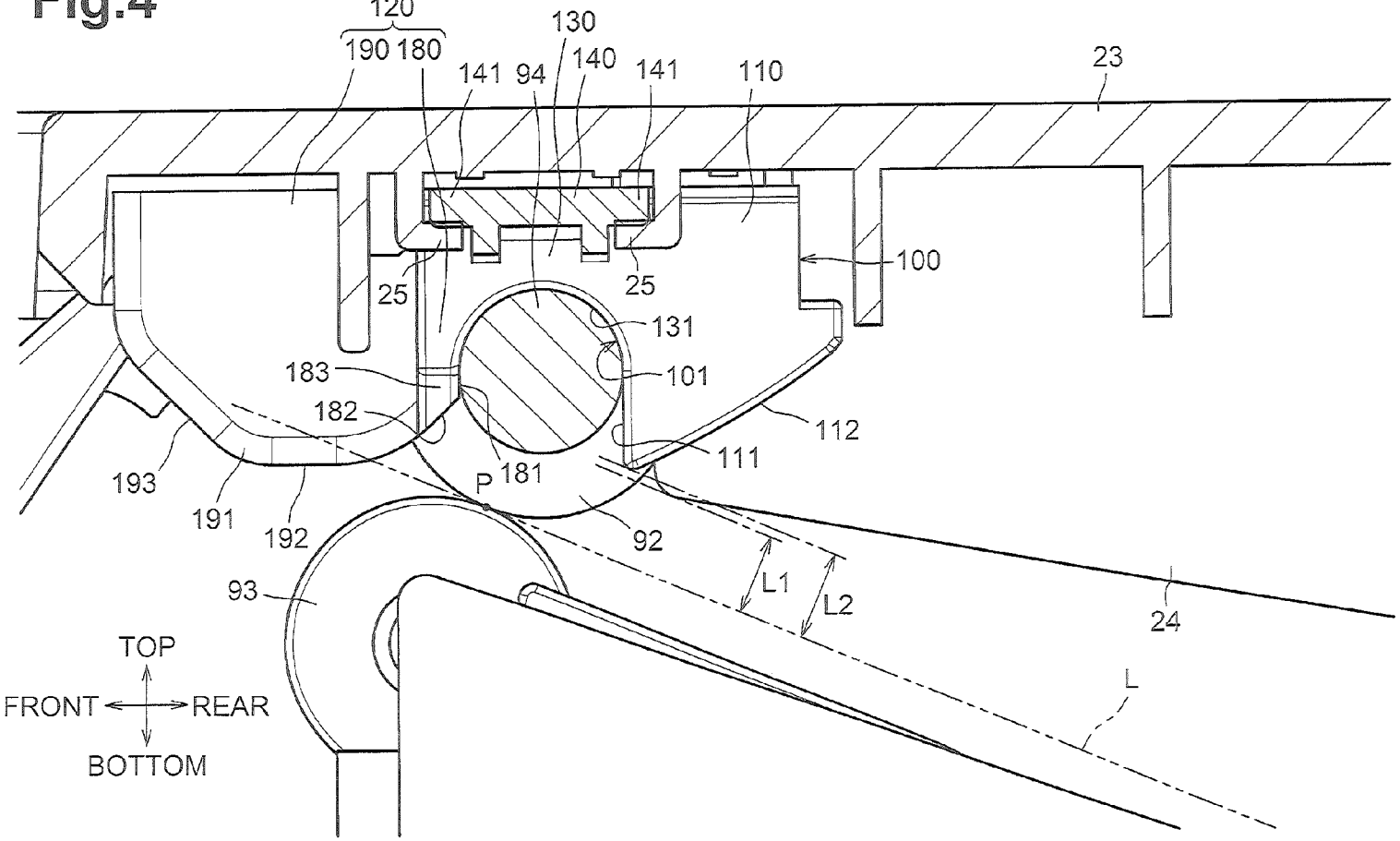
FIG. 4 is a cross-sectional view of the bearing member and its surrounding components.
Figure 5A:
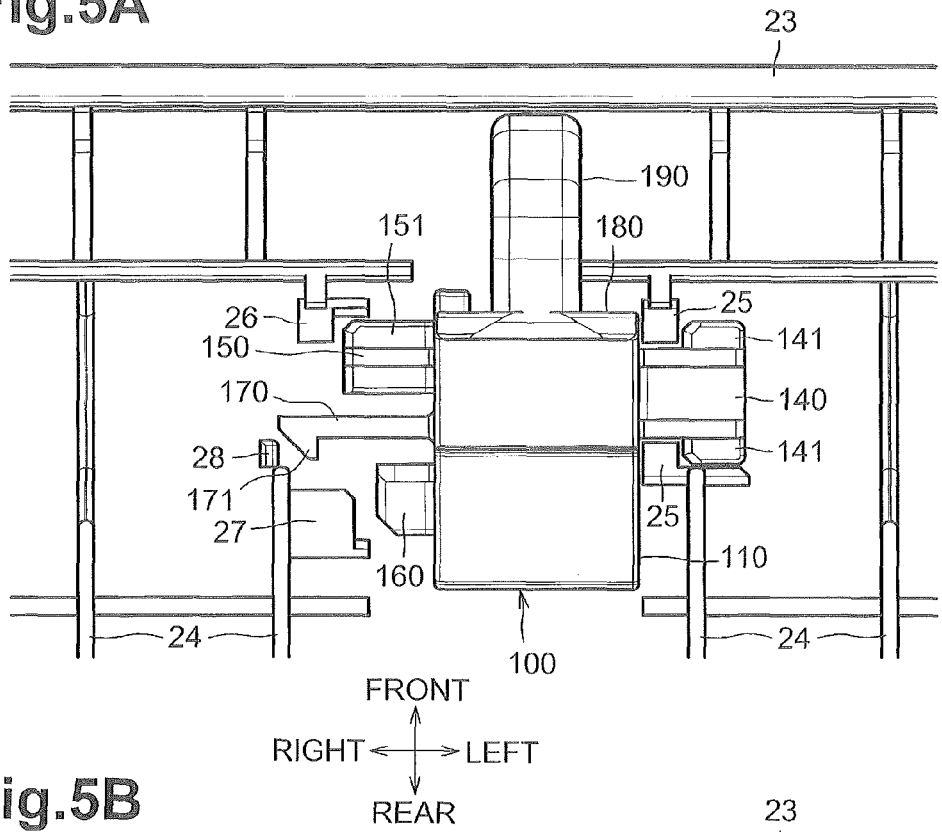
FIGS. 5A and 5B are schematic diagrams of the bearing member and a top cover, illustrating processes of attaching the bearing member to the top cover.

The guide ribs 24 are integrally formed with the top cover 23. The guide ribs 24 are elongated in the front-rear direction. Referring to FIG. 4, a guide rib 24 is disposed upstream of a contact point P between a first discharge roller 92 and a second discharge roller 93 in a conveying direction of a sheet Sand configured to guide a sheet S between the first discharge roller 92 and the second discharge roller 93. Referring to FIG. 5A, the guide ribs 24 are arranged at respective positions along the left-right direction.

Figure 2:
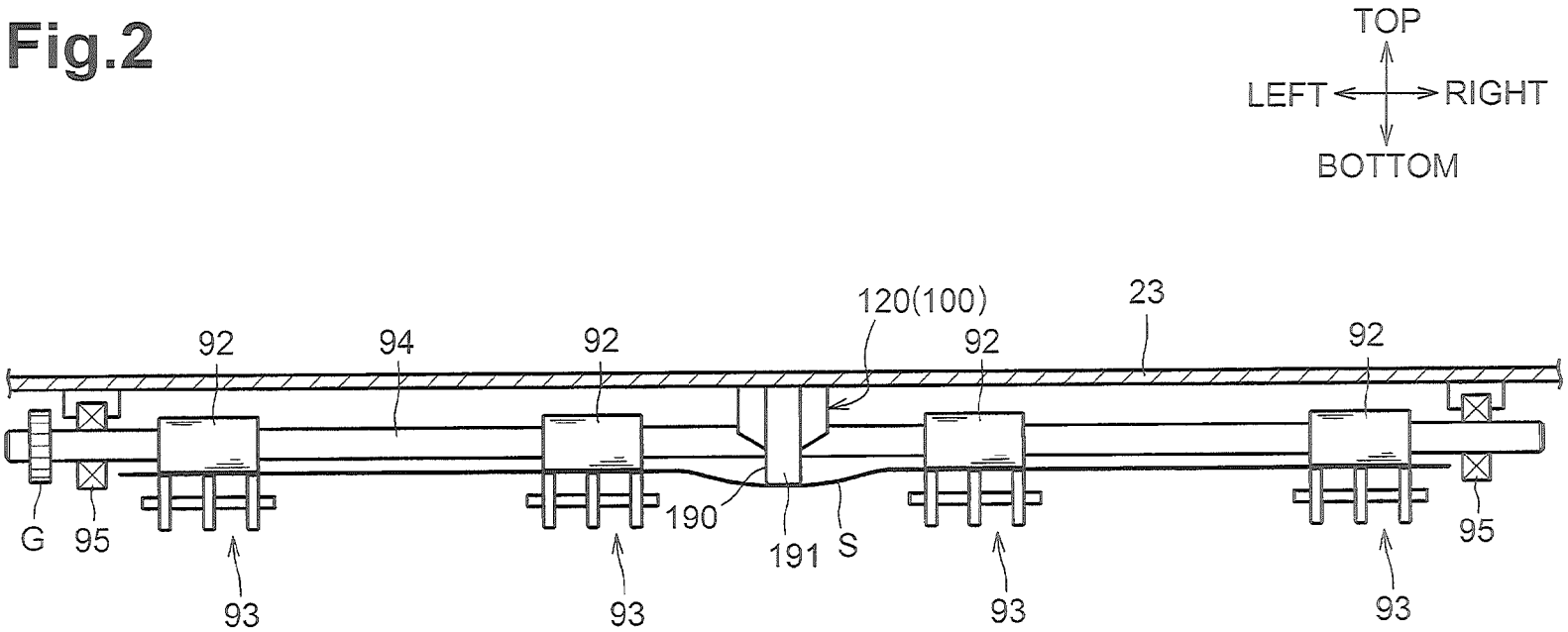
FIG. 2 is a front view of first discharge rollers, second discharge rollers, and a bearing member.

As depicted in FIG. 2, the first discharge rollers 92 are aligned along an axial direction thereof, e.g., the left-right direction. The first discharge rollers 92 are supported by a roller shaft 94. Each of the first discharge rollers 92 is a cylindrical roller formed of, for example, rubber.

The roller shaft 94 extends in the left-right direction. A gear G is fixed to a left end portion of the roller shaft 94. The roller shaft 94 is inserted into the first discharge rollers 92 and is configured to rotate together with the first discharge rollers 92. With this structure, the first discharge rollers 92 are configured to rotate in response to the input of drive force from a drive source to the gear G.

Left and right end portions of the roller shaft 94 are rotatably supported by the top cover 23, via respective bearings 95. A central portion of the roller shaft 94 in the left-right direction is rotatably supported by a bearing member 100.

The second discharge rollers 93 are provided in one-to-one correspondence with the first discharge rollers 92. Each of the second discharge rollers 93 is rotatably supported by the casing 2 at least partially below a corresponding first discharge roller 92. In response to the rotation of the respective first discharge rollers 92, the second discharge rollers 93 are configured to rotate following the rotation of the first discharge rollers 92, due to frictional force with the first discharge rollers 92 (or a sheet S).

The bearing member 100 is entirely located between two adjacent first discharge rollers 92 that are located at the central portion of the roller shaft 94 in the left-right direction. The bearing member 100 is attached to the top cover 23.

Figure 3A:
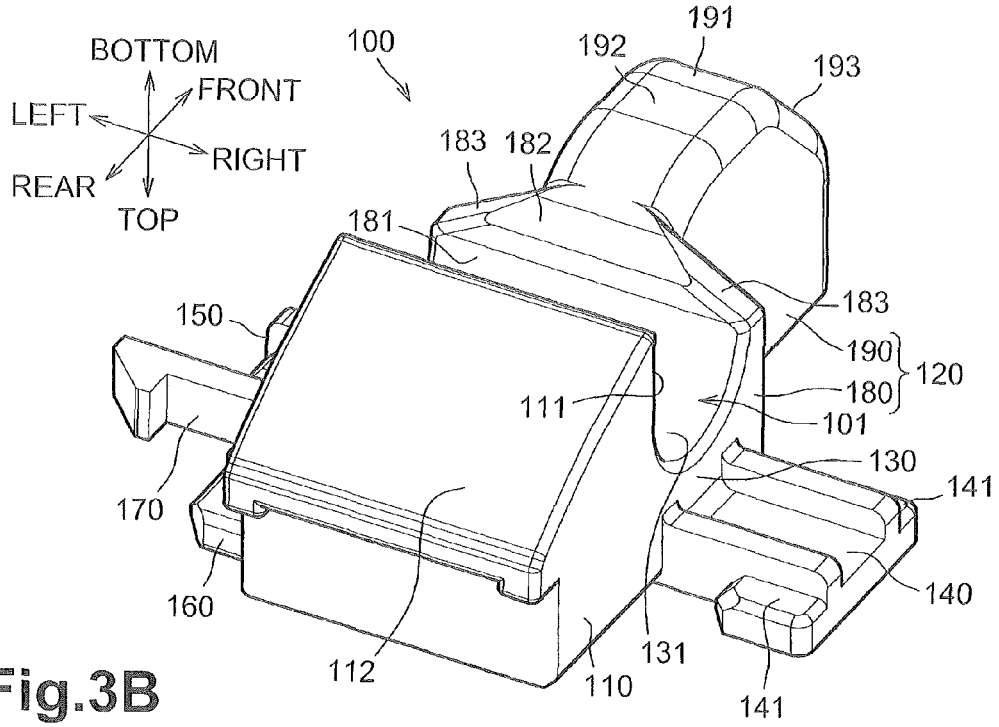
FIG. 3A is a perspective view of the bearing member.

As depicted in FIG. 3A, the bearing member 100 includes a support surface 101 disposed at a central portion of a lower surface of the bearing member 100 in the front-rear direction. The support surface 101 has a shape of a recess with an opening facing toward the second discharge rollers 93, e.g., a lower side. The roller shaft 94 engages the support surface 101. The support surface 101 includes a curved surface portion 131, which is located above the roller shaft 94 and has an arc-shaped cross section conforming to the roller shaft 94, an upstream support surface 111 extending downward from a rear end of the curved surface portion 131, and a downstream support surface 181 extending downward from a front end of the curved surface portion 131. As depicted in FIG. 4, the bearing member 100 is in contact with the roller shaft 94 at the curved surface portion 131, the upstream support surface 111, and the downstream support surface 181 of the support surface 101. As the roller shaft 94 is supported by the support surface 101, the roller shaft 94 may be prevented from bending or flexing when the first discharge rollers 92 receive force from the second discharge rollers 93 and the force is applied to the roller shaft 94.

Referring back to FIG. 3A, the bearing member 100 includes an upstream guide 110 disposed behind the support surface 101, e.g., upstream of the roller shaft 94 in the conveying direction of a sheet S, a downstream guide 120 disposed in front of the support surface 101, e.g., downstream of the roller shaft 94 in the conveying direction of a sheet S, and a connecting portion 130 that connects the upstream guide 110 and the downstream guide 120. The support surface 101 is contiguous with the upstream guide 110 in the conveying direction. The support surface 101 is contiguous with the downstream guide 120 in the conveying direction. For example, the support surface 101 is disposed between the upstream guide 110 and the downstream guide 120. For attaching the bearing member 100 to the top cover 23, the bearing member 100 includes a first attachment portion 140, a second attachment portion 150, a third attachment portion 160, and a fourth attachment portion 170. The first attachment portion 140 is disposed at a right side portion of the bearing member 100. The second attachment portion 150, the third attachment portion 160, and the fourth attachment portion 170 are disposed at a left side portion of the bearing member 100.

The upstream guide 110 has an inclined surface 112 that is formed on a lower surface thereof. The inclined surface 112 extends frontward, e.g., toward a downstream side in the conveying direction of a sheet S, and downward. A front surface of the upstream guide 110 is constituted by the upstream support surface 111 of the support surface 101.

As depicted in FIG. 4, the upstream guide 110 is disposed further from a tangential line L at the contact point P between the first discharge roller 92 and the second discharge roller 93 than the guide rib 24 formed at the top cover 23. In one example, a distance L1 between the tangential line L and a portion of an end of the guide rib 24 closest to the tangential line L is shorter than a distance L2 between the tangential line L and a portion of the upstream guide 110 closest to the tangential line L (e.g., a corner portion between the upstream support surface 111 and the inclined surface 112 in the illustrative embodiment).

The downstream guide 120 includes a first portion 180 disposed adjacent to the roller shaft 94, and a second portion 190 disposed in front of the first portion 180, e.g., on a downstream side in the conveying direction of a sheet S. The first portion 180 is disposed overlapping with the first discharge roller 92 when viewed in the left-right direction. A rear end portion, e.g., an upstream end portion in the conveying direction of a sheet S, of the second portion 190 overlaps with the first discharge roller 92 when viewed in the left-right direction.

Figure 3B:
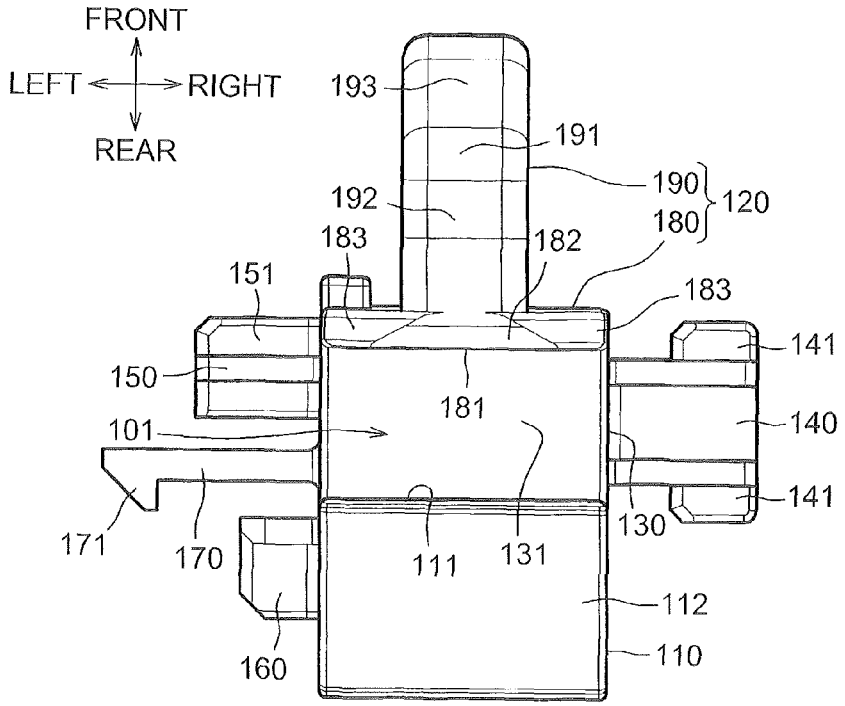
FIG. 3B is a bottom view of the bearing member.

As depicted in FIG. 3B, the width of the first portion 180 in the left-right direction is equal to the width of the upstream guide 110 in the left-right direction. As depicted in FIG. 3A, a rear surface of the first portion 180 is constituted by the downstream support surface 181 of the support surface 101. The first portion 180 includes a guide surface 182 extending from the support surface 101 toward a downstream side in the conveying direction of a sheet S, e.g., frontward, and downward, and outer portions 183 disposed on the respective right and left sides of the guide surface 182. The outer portions 183 extend outward in the left-right direction from the respective left and right sides of the guide surface 182 and upward, away from the tangential line L at the contact point P between the first discharge roller 92 and the second discharge roller 93.

As depicted in FIGS. 3A and 3B, the second portion 190 extends forward from a central portion of the first portion 180 in the left-right direction. The width of the second portion 190 in the left-right direction is smaller than the width of the upstream guide 110 in the left-right direction. In one example, the width of the second portion 190 in the left-right direction is approximately a half of the width of the upstream guide 110 in the left-right direction in the illustrative embodiment.

The second portion 190 is downwardly convex at a central portion thereof in the front-rear direction in side view. The second portion 190 includes a first surface 192 extending frontward and downward from the guide surface 182, and a second surface 193 extending frontward and upward from the first surface 192. The second portion 190 includes a protrusion 191 disposed at a corner portion between the first surface 192 and the second surface 193. As depicted in FIG. 4, the protrusion 191 protrudes toward the second discharge roller 93 beyond the tangential line L at the contact point P between the first discharge roller 92 and the second discharge roller 93, when viewed in the left-right direction.

The connecting portion 130 connects upper portions of the upstream guide 110 and the downstream guide 120. A lower surface of the connecting portion 130 is constituted by the curved surface portion 131. As depicted in FIGS. 3A and 3B, the width of the connecting portion 130 in the left-right direction is the same as the width of the upstream guide 110 in the left-right direction and the width of the first portion 180 in the left-right direction.

The first attachment portion 140 extends outward in the left-right direction, e.g., rightward, from a right side surface of the connecting portion 130. The first attachment portion 140 includes a pair of first engagement portions 141 protruding in the front-rear direction.

The second attachment portion 150 extends outward in the left-right direction e.g., leftward, from a left side surface of the connecting portion 130. The second attachment portion 150 includes a second engagement portion 151 protruding frontward.

The third attachment portion 160 extends outward in the left-right direction, e.g., leftward, from a left side surface of the upstream guide 110.

The fourth attachment portion 170 extends outward in the left-right direction, e.g., leftward, from a portion of a left side surface of the connecting portion 130 between the second attachment portion 150 and the third attachment portion 160. The fourth attachment portion 170 includes a hook 171 disposed at an end thereof.

A structure provided at the top cover 23 for mounting or attaching the bearing member 100 to the top cover 23 will be described below.

As depicted in FIG. 5A, a lower surface of the top cover 23 includes a pair of first engagement portions 25 arranged along the front-rear direction, a second engagement portion 26 and a third engagement portion 27 that are arranged along the front-rear direction to the right of the first engagement portions 25, a fourth engagement portion 28 disposed between the second engagement portion 26 and the third engagement portion 27.

Each of the first engagement portions 25 has a hook shape (refer to FIG. 4), extending downward from the lower surface of the top cover 23 and then extending in the front-rear direction to face each other. The second engagement portion 26 is disposed in front of the third engagement portion 27. Each of the second engagement portion 26 and the third engagement portion 27 has a hook shape extending downward from the lower surface of the top cover 23 and then extending in the front-rear direction to face each other, similar to the first engagement portions 25. The fourth engagement portion 28 is a protrusion protruding downward from the top cover 23.

Figure 5B:
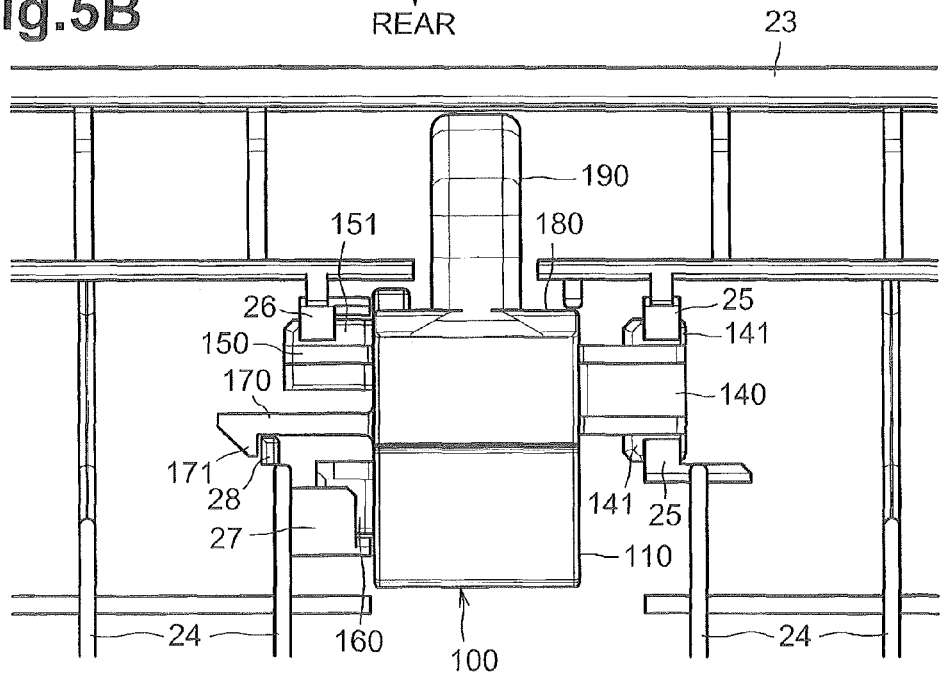

The bearing member 100 is mounted to the top cover 23 as structured above, by slidably moving the bearing member 100 from the left to the right, relative to the top cover 23. In one example, as depicted in FIG. 5B, each of the first engagement portions 141 of the first attachment portion 140 engages a corresponding one of the first engagement portions 25. The second engagement portion 151 of the second attachment portion 150 engages the second engagement portion 26. The third attachment portion 160 engages the third engagement portion 27. Further, the hook 171 of the fourth attachment portion 170 engages the fourth engagement portion 28.

Operations and effects of the discharge unit 9 as structured above will be described.

As depicted in FIG. 4, a sheet S conveyed along the discharge path 91 is guided by the guide rib 24 and is conveyed between the first discharge roller 92 and the second discharge roller 93. At this time, the distance L1 between the tangential line L and the portion of the end of the guide rib 24 closest to the tangential line L is shorter than the distance L2 between the tangential line L and the portion of the upstream guide 110 closest to the tangential line L. Therefore, the sheet S conveyed along the discharge path 91 may be reliably guided between the first discharge roller 92 and the second discharge roller 93 by the guide rib 24. In FIG. 5B, the sheet S may be guided by the upstream guide 110 of the bearing member 100 at a position between the guide ribs 24, and is conveyed between the first discharge roller 92 and the second discharge roller 93.

Referring back to FIG. 4, the sheet S passing between the first discharge roller 92 and the second discharge roller 93 contacts the protrusion 191 of the second portion 190 of the downstream guide 120. In one example, the sheet S passing between the first discharge roller 92 and the second discharge roller 93 contacts the first surface 192 of the second portion 190. Then, the sheet S is conveyed while making contact with the protrusion 191. While the sheet S is conveyed contacting the protrusion 191, as depicted in FIG. 2, a central portion of the sheet S in the left-right direction is flexed. Thus, as a portion of the sheet S in the width direction is flexed, a leading end of the sheet S that have passed between the first discharge roller 92 and the second discharge roller 93 may be prevented from hanging down. Therefore, the leading end of the sheet S may not push a sheet S already discharged on the discharge tray 22.

In the illustrative embodiment, the bearing member 100 configured to support the roller shaft 94 includes the protrusion 191 configured to flex a sheet S. Therefore, an error in the relationship between the position of the protrusion 191 and a position where the first discharge roller 92 and the second discharge roller 93 hold a sheet S therebetween may not readily occur. Accordingly, a position in which the first discharge roller 92 and the second discharge roller 93 hold a sheet S therebetween and a position of the bearing member 100 in which the protrusion 191 contacts and flexes the sheet S may be stabilized.

The width of the protrusion 191, in the left-right direction, configured to contact a sheet S is smaller than the width of the upstream guide 110 in the left-right direction or the width of the first portion 180 of the downstream guide 120 in the left-right direction. Therefore, the amount of contact between a sheet S and the protrusion 191, which is configured to flex the sheet S, may be minimized and resistance in conveying the sheet S may be reduced. As the widths of the upstream guide 110 and the first portion 180, which are configured to guide conveyance of a sheet S, are greater than the width of the protrusion 191, conveyance of a sheet S may stabilize.

The first portion 180 includes the outer portions 183 that are disposed to the respective right and left sides of the guide surface 182 configured to guide conveyance of a sheet S, and that extend in the upward direction away from the guide surface 182. Accordingly, a sheet S may minimally come in contact with the first portion 180, and resistance in conveying the sheet S may be reduced. Especially, in the illustrative embodiment, this structure is effective because a sheet S is likely to come in contact with the first portion 180, which is disposed overlapping with the first discharge roller 92 when viewed in the left-right direction.

While the disclosure has been described in detail with reference to the specific embodiment, it is to be understood that the disclosure is not limited thereto. Various changes, arrangements and modifications may be applied without departing from the spirit and scope of the disclosure.

In the above-described illustrative embodiment, the bearing member 100 is disposed between two adjacent first discharge rollers 92 that are located at the central portion of the roller shaft 94 in the left-right direction. In another embodiment, a plurality of bearing members 100 may be provided. For example, the bearing members 100 each may be disposed between every two adjacent first discharge rollers 92.

In the above-described illustrative embodiment, the downstream guide 120 includes the first portion 180, and the second portion 190 having a width in the left-right direction smaller than that of the first portion 180. The second portion 190 includes the protrusion 191 protruding toward the second discharge roller 93 beyond the tangential line L at the contact point P between the first discharge roller 92 and the second discharge roller 93, when viewed in the left-right direction. However, the structure of the downstream guide 120 is not limited thereto. For example, a downstream guide may entirely have a constant width in the left-right direction. The width of the first portion 180 and the width of the second portion 190 may be smaller in the left-right direction than the width of the upstream guide 110.

In the above-described illustrative embodiment, the downstream guide 120 includes the protrusion 191 protruding toward the second discharge roller 93 beyond the tangential line L at the contact point P between the first discharge roller 92 and the second discharge roller 93, when viewed in the left-right direction. However, the structure of the bearing member 100 is not limited thereto. For example, in addition to the downstream guide 120, the upstream guide 110 may also protrude toward the second discharge roller 93 beyond the tangential line L at the contact point P between the first discharge roller 92 and the second discharge roller 93, when viewed in the left-right direction. In another embodiment, only the upstream guide 110 may protrude toward the second discharge roller 93 beyond the tangential line L at the contact point P between the first discharge roller 92 and the second discharge roller 93, when viewed in the left-right direction.

What is claimed is:

1. A sheet conveying device comprising:

a casing;

a plurality of first discharge rollers arranged in an axial direction, the plurality of first discharge rollers including two first discharge rollers adjacent to each other;

a roller shaft supporting the plurality of first discharge rollers and configured to rotate together with the plurality of first discharge rollers;

a plurality of second discharge rollers provided in correspondence with the plurality of first discharge rollers, the plurality of second discharge rollers including two second discharge rollers adjacent to each other and corresponding to the two first discharge rollers, each of the plurality of first discharge rollers and a corresponding one of the plurality of second discharge rollers being configured to hold and convey a sheet therebetween; and a bearing member attached to the casing such that the bearing member is entirely located between the two first discharge rollers, the bearing member supporting the roller shaft, wherein the bearing member includes a downstream guide located downstream of the roller shaft in a conveying direction in which the sheet is conveyed, wherein the downstream guide of the bearing member protrudes toward the plurality of second discharge rollers beyond a tangential line at a contact point between one of the plurality of first discharge rollers and a corresponding one of the plurality of second discharge rollers, when viewed in the axial direction, and wherein the bearing member includes a recessed portion being open toward the plurality of second discharge rollers, the recessed portion having a support surface contacting the roller shaft, the support surface being contiguous with the downstream guide in the conveying direction.

2. The sheet conveying device according to claim 1, wherein the bearing member further includes an upstream guide located upstream of the roller shaft in the conveying direction, wherein the downstream guide includes a protrusion protruding toward the plurality of second discharge rollers beyond the tangent line when viewed in the axial direction, and wherein the protrusion has a width smaller in the axial direction than a width of the upstream guide.

3. The sheet conveying device according to claim 1, wherein the downstream guide of the bearing member includes a first portion and a second portion disposed downstream of the first portion and having a width smaller in the axial direction than a width of the first portion, the first portion having a guide surface approaching the tangent line toward a downstream side in the conveying direction, the second portion including a protrusion protruding toward the plurality of second discharge rollers beyond the tangent line.

4. The sheet conveying device according to claim 3, wherein the bearing member further includes an upstream guide located upstream of the roller shaft in the conveying direction, and wherein the width of the first portion of the downstream guide is equal in the axial direction to a width of the upstream guide.

5. The sheet conveying device according to claim 3, wherein the first portion of the downstream guide includes an outer portion disposed on each side of the guide surface in the axial direction, the outer portion extending outward in the axial direction from each side of the guide surface, away from the tangential line.

6. The sheet conveying device according to claim 3, wherein the first portion of the downstream guide is disposed overlapping with the plurality of first discharge rollers when viewed in the axial direction.

7. The sheet conveying device according to claim 3, wherein an upstream end portion, in the conveying direction, of the second portion of the downstream guide is disposed overlapping with the plurality of first discharge rollers when viewed in the axial direction.

8. The sheet conveying device according to claim 3, wherein the bearing member further includes an upstream guide located upstream of the roller shaft in the conveying direction, and wherein the support surface includes a curved surface portion having an arc-shaped cross section conforming to the roller shaft, an upstream support surface constituting a surface of the upstream guide and extending from the curved surface portion toward the plurality of second discharge rollers, and a downstream support surface constituting a surface of the first portion of the downstream guide and extending from the curved surface portion toward the plurality of second discharge rollers.

9. The sheet conveying device according to claim 1, further comprising a guide rib disposed upstream of the contact point in the conveying direction, the guide rib being configured to guide the sheet between each of the plurality of first discharge rollers and a corresponding one of the plurality of second discharge rollers, wherein the bearing member further includes an upstream guide located upstream of the roller shaft in the conveying direction, and wherein a first distance between the tangential line and a portion of an end of the guide rib closest to the tangential line is smaller than a second distance between the tangential line and a portion of the upstream guide closest to the tangential line.

10. The sheet conveying device according to claim 9, wherein the casing includes a cover covering a path through which a sheet is conveyed, wherein the guide rib is integrally formed with the cover, and wherein the bearing member is attached to the cover.

11. The sheet conveying device according to claim 1, wherein the bearing member supports a central portion of the roller shaft in the axial direction.

* * * * *